United States Patent [19]

Kawanabe et al.

[11] Patent Number: 4,705,012

[45] Date of Patent: Nov. 10, 1987

[54] AIR INTAKE SIDE SECONDARY AIR SUPPLY SYSTEM FOR AN INTERNAL COMBUSTION ENGINE WITH A DUTY RATIO CONTROL OPERATION

[75] Inventors: Tomohiko Kawanabe, Utsunomiya; Masahiko Asakura, Tokorozawa; Noritaka Kushida, Tokyo; Takanori Shiina, Utsunomiya; Minoru Muroya, Wako, all of Japan

[73] Assignee: Honda Giken Kogyo Kaibushiki Kaisha, Tokyo, Japan

[21] Appl. No.: 807,716

[22] Filed: Dec. 11, 1985

[30] Foreign Application Priority Data

Feb. 16, 1985 [JP] Japan ..... 60-28757
Apr. 26, 1985 [JP] Japan ..... 60-90652

[51] Int. Cl.[4] ..... F02M 23/04
[52] U.S. Cl. ..... 123/589
[58] Field of Search ..... 123/440, 489, 589

[56] References Cited

U.S. PATENT DOCUMENTS 4,434,768 3/1984 Ninomiya ..... 123/589 X
4,478,192 10/1984 Kinoshita et al. ..... 123/589 X
4,485,786 12/1984 Kashimura ..... 123/589 X
4,503,834 3/1985 Hasegawa ..... 123/589
4,553,521 11/1985 Kishida et al. ..... 123/589 X
4,566,419 1/1986 Ninomiya et al. ..... 123/440 X

*Primary Examiner*—Willis R. Wolfe, Jr.
*Attorney, Agent, or Firm*—Pollock, Vande Sande & Priddy

[57] ABSTRACT

An air intake side secondary air supply system for an internal combustion engine has an air intake system using a carburetor and an air intake side secondary air supply passage leading downstream of the carburetor. The passage includes an oxygen concentration sensor producing an output signal whose level is substantially proportional to an oxygen concentration of the exhaust gas. A control means for controlling a flow control valve is disposed in the air intake side secondary air supply passage and operates in accordance to the output signal of the oxygen concentration sensor. In a variation of the invention, the feedback control of air-fuel ratio using the output signal of the oxygen concentration sensor is effected only when the engine operational state is in a predetermined operational region.

8 Claims, 9 Drawing Figures

AIR INTAKE SIDE SECONDARY AIR SUPPLY SYSTEM FOR AN INTERNAL COMBUSTION ENGINE WITH A DUTY RATIO CONTROL OPERATION

BACKGROUND OF THE INVENTION

1. Field of the Invention

The present invention relates to an air intake side secondary air supply system for an internal combustion engine.

2. Description of Background Information

Air-fuel ratio feedback control systems for an internal combustion engine are well known as systems in which oxygen concentration in the exhaust gas of the engine is detected by an oxygen concentration sensor (referred to as $O_2$ sensor hereinafter) and the air-fuel ratio of mixture to be supplied to the engine is feedback controlled in response to an output signal level of the $O_2$ sensor for the purification of the exhaust gas and an improvement of the fuel economy. As an example of the air-fuel ratio feedback control system, an air-intake side secondary air supply system for the feedback control is proposed, for example, in Japanese Patent Publication No. 55-3533. In conventional air intake side secondary air supply systems, it is usual to control the air-fuel ratio of the mixture to be supplied to the engine toward a single target air-fuel ratio which has been determined previously. However, there are some occasions in driving conditions of the engine where it is desirable to vary the target air-fuel ratio for improving the driveability. Therefore, it is been desirable that the air-fuel ratio of the mixture to be supplied to the engine is controlled to a target air-fuel ratio which is arbitrarily varied according to the driving condition of the engine.

Further, if a fluctuation of the air-fuel ratio of the mixture from the target air-fuel ratio occurs due to a change in the engine load, from a light load to a heavy load for example, it has resulted in a delay of the air-fuel ratio control because of time required for detecting the fluctuation of the air-fuel ratio by means of the $O_2$ sensor as a change in the oxygen concentration in the exhaust gas. For this reason, there exists a problem of the driveability being deteriorated by the delay of the response of the air-fuel ratio control.

OBJECT AND SUMMARY OF THE INVENTION

An object of the present invention is to provide an air intake side secondary air supply system for an internal combustion engine, in which the air-fuel ratio is accurately controlled to a target air-fuel ratio which is varied arbitrarily.

Another object of the present invention is to provide an air intake side secondary air supply system for an internal combustion engine which provides an improved driveability of the engine while a change in the engine load occurs.

According to the present invention, an air intake side secondary air supply system includes a flow control valve disposed in an air intake side secondary air supply passage and an oxygen sensor for producing an output signal having a level substantially proportional to the oxygen concentration in the exhaust gas. The system drives the flow control valve in accordance with an output signal level of the $O_2$ sensor.

According to another aspect of the present invention, an air intake side secondary air supply system sets a base valve open period for an open/close valve disposed in an air intake side secondary air supply passage according to a plurality of parameters of engine operation for every predetermined control period. When the engine is operating under a predetermined first operating condition, the system effects a correction to the base valve open period in response to an output signal level of the $O_2$ sensor, to provide an output valve open period, so that the air-fuel ratio of the mixture to be supplied to the engine is controlled to a target air-fuel ratio by a feedback operation. When, on the other hand, the engine is operating under a second predetermined operating condition other than the first predetermined operating condition, the system provides the basic valve open period as the output valve open period. The open/close valve is opened for a duration of the output valve open period within each predetermined control period.

DETAILED DESCRIPTION OF THE PREFERRED EMBODIMENTS

Referring to FIGS. 1 through 7 of the accompanying drawings, the first embodiment of the air intake side secondary air supply system according to the present invention will be explained hereinafter.

Figure 1:
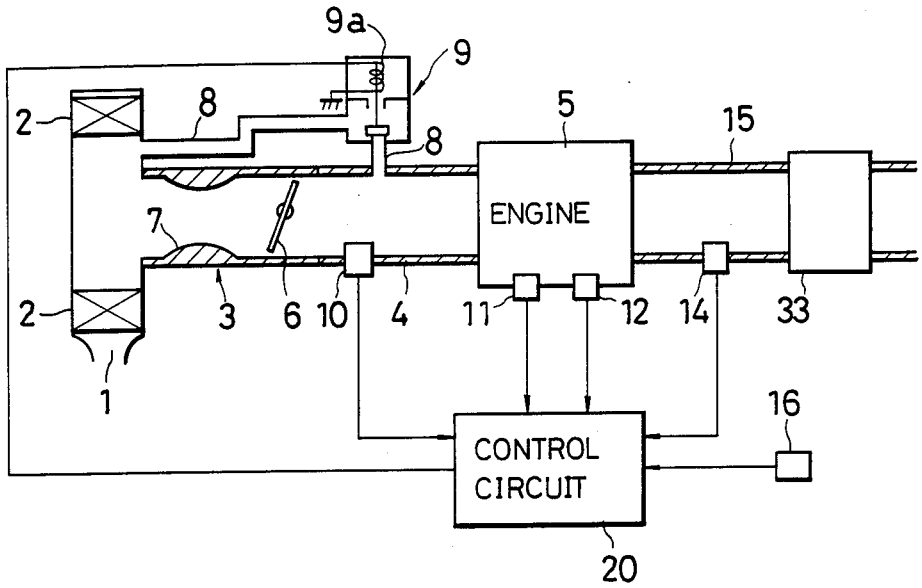
FIG. 1 is a schematic diagram showing a general construction of the system according to the invention.

In FIG. 1 which illustrates a general construction of the air intake side secondary air supply system, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. An inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid 9*a* thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean $O_2$ sensor 14 which is provided in an exhaust manifold 15 of the engine for generating an output signal whose level varies in proportion to an oxygen concentration in the exhaust gas.

Figure 2:
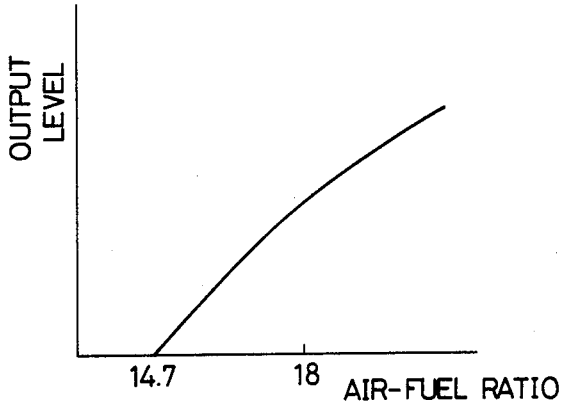
FIG. 2 is a diagram showing a signal output characteristic of the $O_2$ sensor 14 used in the system of FIG. 1.

FIG. 2 shows a signal output characteristic of the $O_2$ sensor 14. As shown, the output signal level of the $O_2$ sensor increases proportionally as the oxygen concentration in the exhaust gas becomes leaner from a stoichiometric air-fuel ratio value. Further, a catalytic converter 33 for accelerating the reduction of the noxious components in the exhaust gas is provided in the exhaust manifold 15 at a location on the downstream side of the position of the $O_2$ sensor 14. The open/close solenoid valve 9, the absolute pressure sensor 10, the crank angle sensor 11, the engine cooling water temperature sensor 12, and the $O_2$ sensor 14 are electrically connected to a control circuit 20. Further, a vehicle speed sensor 16 for producing an output signal whose level is proportional to the speed of the vehicle is electrically connected to the control circuit 20.

Figure 3:
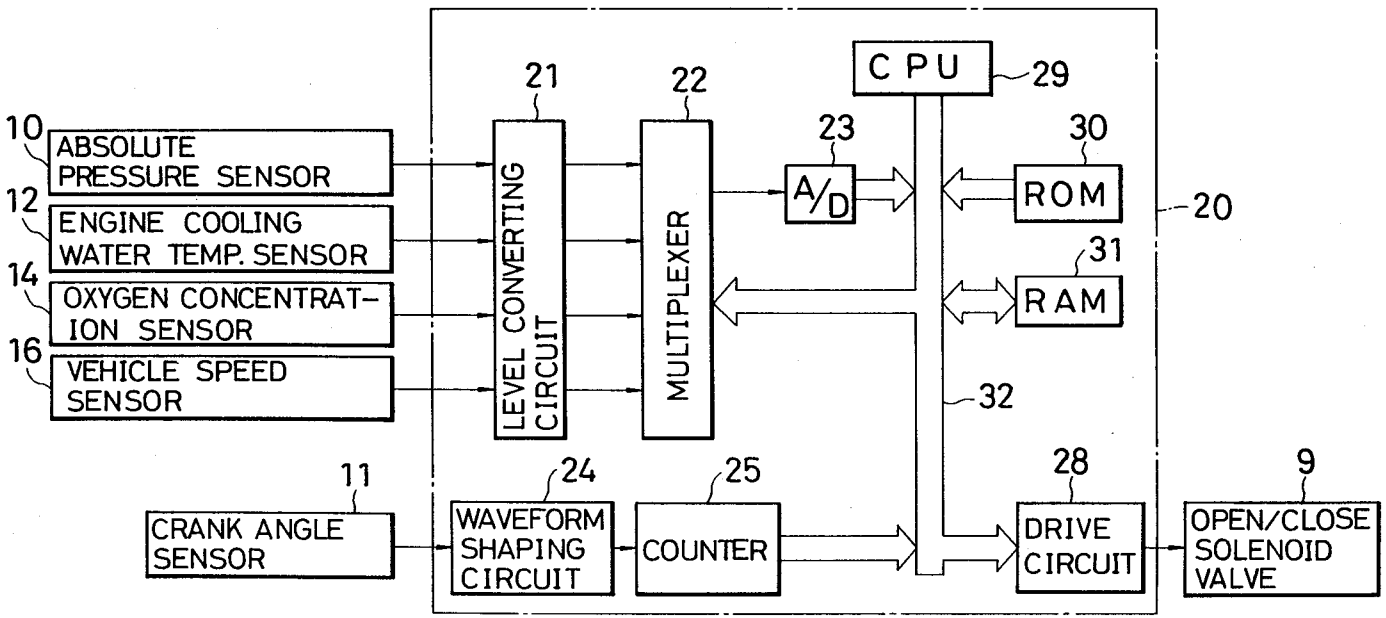
FIG. 3 is a block diagram showing the construction of the control circuit 20 of the system of FIG. 1.

FIG. 3 shows the construction of the control circuit 20. As shown, the control circuit 20 includes a level converting circuit 21 which effects a level conversion of the output signals of the absolute pressure sensor 10, the engine cooling water temperature sensor 12, the $O_2$ sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter 23 in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the open/close solenoid valve 9 in an opening direction, a CPU (central processing unit) 29 which performs digital operations according to various programs, and a ROM 30 in which various operating programs and data are previously stored, and a RAM 31. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed, and information indicative of the engine speed are selectively supplied from the A/D converter 23 and the counter 25 respectively, to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter.

Figure 4:
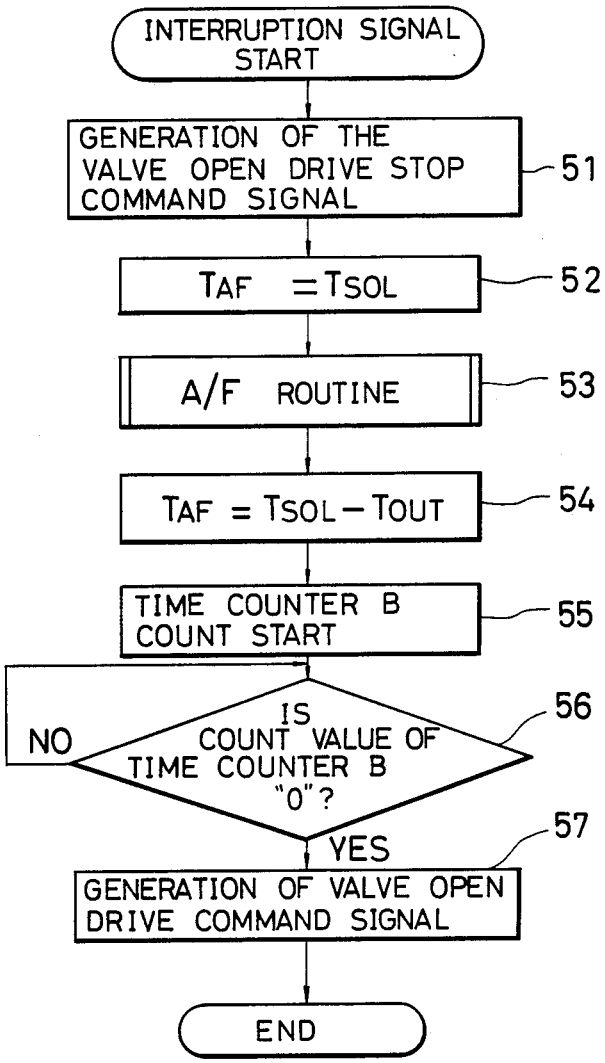
FIGS. 4 and 5 are flowcharts showing the manner of operation of a CPU 29 in the control circuit 20 in the case of a first embodiment of the air intake side secondary air supply system according to the present invention.
Figure 5:
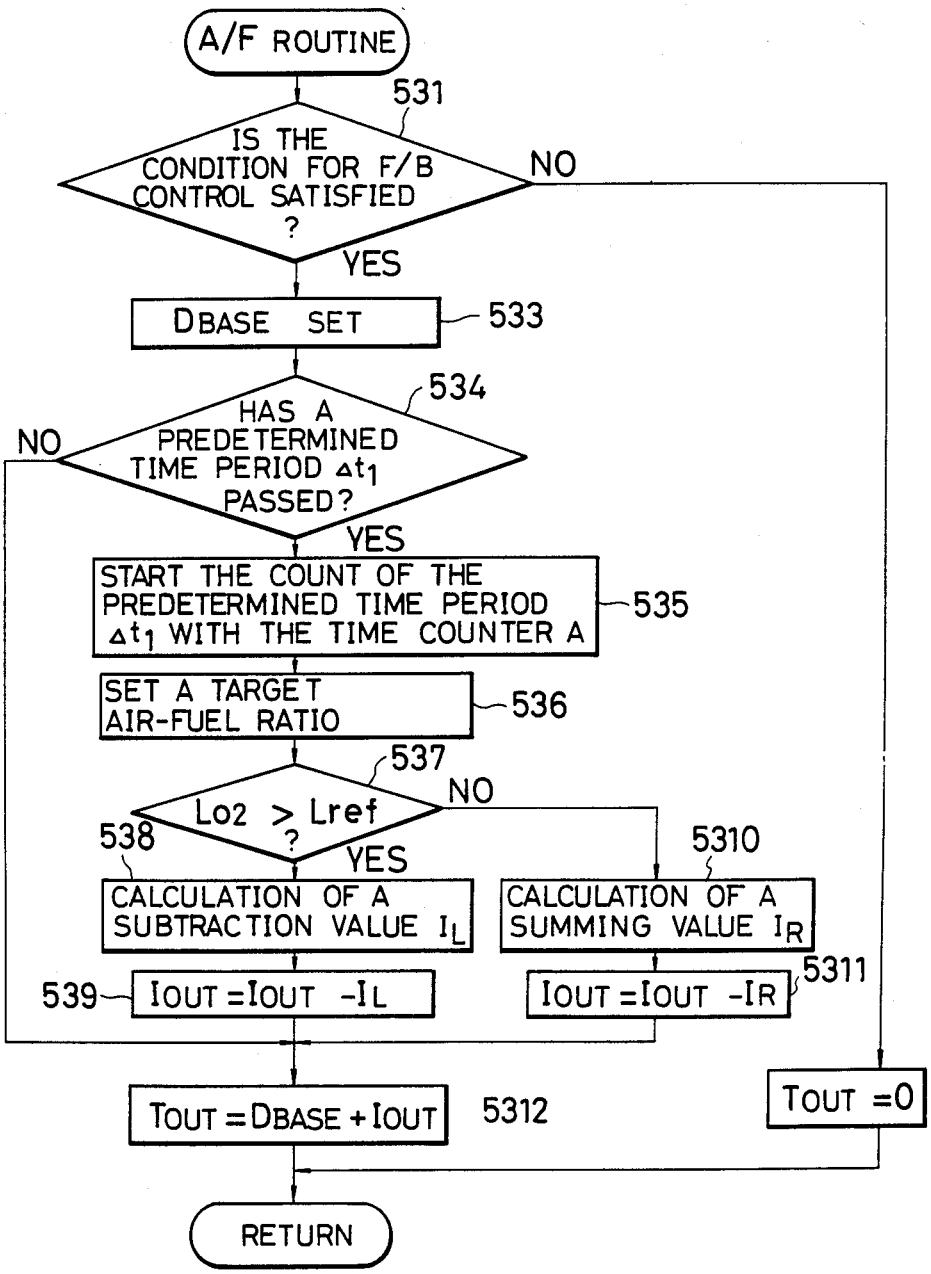

Referring to the flowcharts of FIGS. 4 and 5, the operation of the air intake side secondary air supply system according to the present invention will be explained hereinafter.

At a step 51, a valve open drive stop command signal is generated in the CPU 29 and supplied to the drive circuit 28, at every time of the generation of the internal interruption signal in the CPU 29. With this signal, the drive circuit 28 is controlled to close the open/close solenoid valve 9. This operation is provided so as to prevent malfunctions of the open/close solenoid valve 9 during the calculating operation of the CPU 29. Next, a valve close period $T_{AF}$ of the open/close solenoid valve 9 is made equal to a period of one duty cycle $T_{SOL}$ at a step 52, and an A/F routine for calculating a valve open period $T_{OUT}$ of the open/close solenoid valve 9 which is shown in FIG. 5 is carried out through steps generally indicated at 53.

Figure 6:
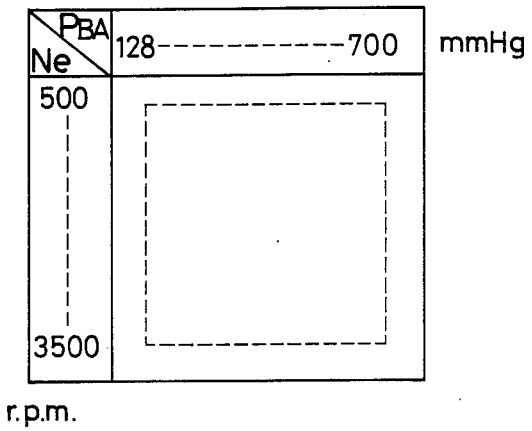
FIG. 6 is a diagram showing a data map which is previously stored in a ROM 30 of the control circuit 20.

In the A/F routine, whether or not operating states of the vehicle (including operating states of the engine) satisfy a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/close solenoid valve 9 is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 6, and the CPU 29 first reads-in current values of the absolute pressure $P_{BA}$ and the engine speed $N_e$ and in turn searches a value of the period of base duty ratio $D_{BASE}$ corresponding to the read-in values from the $D_{BASE}$ data map in the ROM 30. Then, whether or not a count period of a time counter A incorporated in the CPU 29 (not shown) has reached a predetermined time period $\Delta t_1$ is detected at a step 534. This predetermined time period $\Delta t_1$ corresponds to a delay time from a time of the supply of the air intake side secondary air to a time in which a result of the supply of the air intake side secondary air is detected by the $O_2$ sensor 11 as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the initial value by the time counter A, i.e. the execution of the step 535, is performed at the step 534. After the start of the counting of the predetermined time period $\Delta t_1$ by the time counter A in this way, a target air-fuel ratio which is leaner than the stoichiometric air-fuel ratio is set at a step 536. For the setting of the target air-fuel ratio, various values for a reference level Lref corresponding to the target air-fuel ratio which is determined according to the values of the absolute pressure within the intake manifold $P_{BA}$ and the engine speed $N_e$ as in the case of the $D_{BASE}$ data map, were previously stored in the ROM 30 as an A/F data map. Therefore, the CPU 29 searches a reference level Lref corresponding to the current values of the absolute pressure $P_{BA}$ and the engine speed $N_e$ from the A/F data map. Next, from the information of the oxygen concentration, whether or not the output signal level $LO_2$ of the $O_2$ sensor 14 is greater than the reference level Lref determined at the step 536 is detected at a step 537. In other words, whether or not an air-fuel ratio of the mixture to be supplied to the engine 5 is leaner than the target air-fuel ratio is detected at the step 537. If $LO_2 > Lref$, it means that the air-fuel ratio of the mixture is leaner than the target air-fuel ratio, and a subtraction value $I_L$ is calculated at a step 538. The subtraction value $I_L$ is obtained by multiplication among a constant $K_1$, the engine speed $N_e$, and the absolute pressure $P_{BA}$, $(K_1 \cdot N_e \cdot P_{BA})$, and is dependent on the amount of the intake air of the engine 5. After the calculation of the subtraction value $I_L$, a correction value $I_{OUT}$ which is previously calculated by the execution of operations of the A/F routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 539. On the other hand, if $LO_2 \leqq Lref$ at the step 537, it means that the current air-fuel ratio of the mixture is richer than the target air-fuel ratio, and a summing value $I_R$ is calculated at a step 5310. The summing value $I_R$ is calculated by a multiplication among a constant value $K_2(\neq K_1)$, the engine speed $N_e$, and the absolute pressure $P_{BA}$ $(K_2 \cdot N_e \cdot P_{BA})$, and is dependent on the amount of the intake air of the engine 5. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 5311. After the calculation of the correction value $I_{OUT}$ at the step 539 or the step 5311 in this way, the correction value $I_{OUT}$ and the period of basic duty ratio $D_{BASE}$ set at the step 533 are added together, and a result of addition is used as the valve open period $T_{OUT}$ at a step 5312.

Additionally, after the reset of the time counter A and the start of the counting from the initial value at the step 535, if it is detected that the predetermined time period $\Delta t_1$ has not yet passed at the step 534, the operation of the step 5312 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$ at a step 54. Subsequently, a value corresponding to the valve close period $T_{AF}$ is set in a time counter B incorporated in the CPU 29 (not shown), and down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is effected repeatedly.

Figure 7:
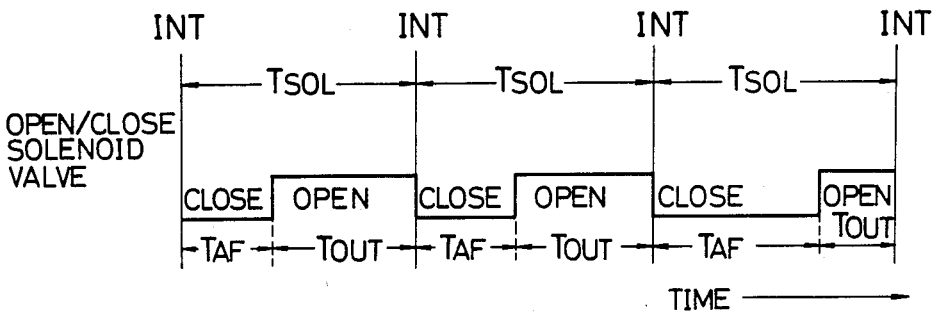
FIG. 7 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 7, to stop the supply of the air intake side secondary air to the engine 5. When the valve close time $T_{AF}$ for the open/close solenoid valve 9 within the period of one duty cycle is calculated and the valve close time $T_{AF}$ has passed after the generation of the interruption signal, the open/close solenoid valve 9 is opened to supply the air intake side secondary air to the engine through the air intake side secondary air supply passage 8. Thus, the duty ratio control of the supply of the air intake side secondary air is performed by repeatedly executing these operations. Further, the air-fuel ratio of the mixture to be supplied to the engine 5 is controlled to the target air fuel ratio by a duty ratio control of the supply of the air intake side secondary air. Through these operations, the accuracy of the air-fuel ratio control and the response characteristic of the control system with respect to the air intake side secondary air supply command are improved. Moreover, the delay of response of the control operation due to the change in the operational state of the engine is compensated for by setting the period of base duty ratio $D_{BASE}$ in accordance with the operating condition of the engine. Moreover, the hunting of the air-fuel ratio is prevented since a control operation in which the time from the supply of the secondary air to the detection of the oxygen concentration is considered is performed in the air intake side secondary air supply system according to the present invention. More particularly, as explained in detail in the above, an "integral term control" operation is performed such that the subtraction value $I_L$ is subtracted from the correction value $I_{OUT}$, or the summation value $I_R$ is added to the correction value $I_{OUT}$ every predetermined time period $\Delta t_1$.

In the above explained embodiment, the open/close solenoid valve 9 is disposed in the air intake side secondary air supply passage. However, the arrangement is not limited to this, and various types of valves such as a pressure responsive open/close valve operated in response to the vacuum of the engine, or a regulation valve whose opening degree is controlled desirably can be used as the regulation valve.

In addition, although a constant time period has been set as the predetermined time period $\Delta t_1$ in the above embodiment, it is also possible to use a value variable in response to the engine operation as the predetermined time period $\Delta t_1$. For instance, the response characteristic of the system can be improved if the predetermined time period $\Delta t_1$ is shortened when the engine rotational speed is high, or when the amount of the intake air of the engine is large.

Moreover, it is also possible to provide a time counter B outside the CPU 29 although the time counter B is incorporated in the CPU 29 in the above embodiment. In that case, it is suitable to arrange the system such that the valve open command signal is supplied to the drive circuit 28 from the time counter B when the count value of the time counter B reaches the value "0".

Figure 8:
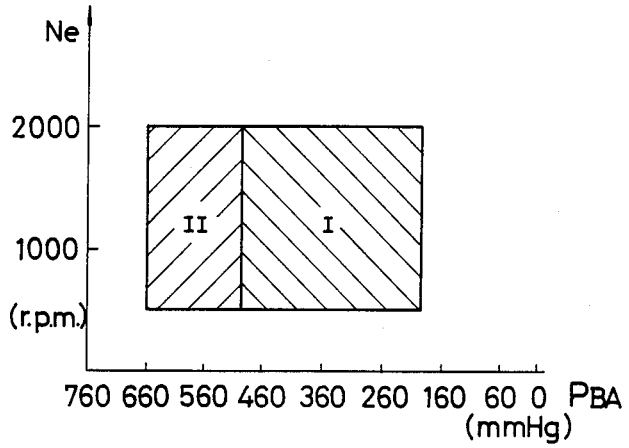
FIG. 8 is a diagram showing first and second operational regions of the engine operation which are used as conditions of operation in a second embodiment of the air intake side secondary air supply system according to the present invention.
Figure 9:
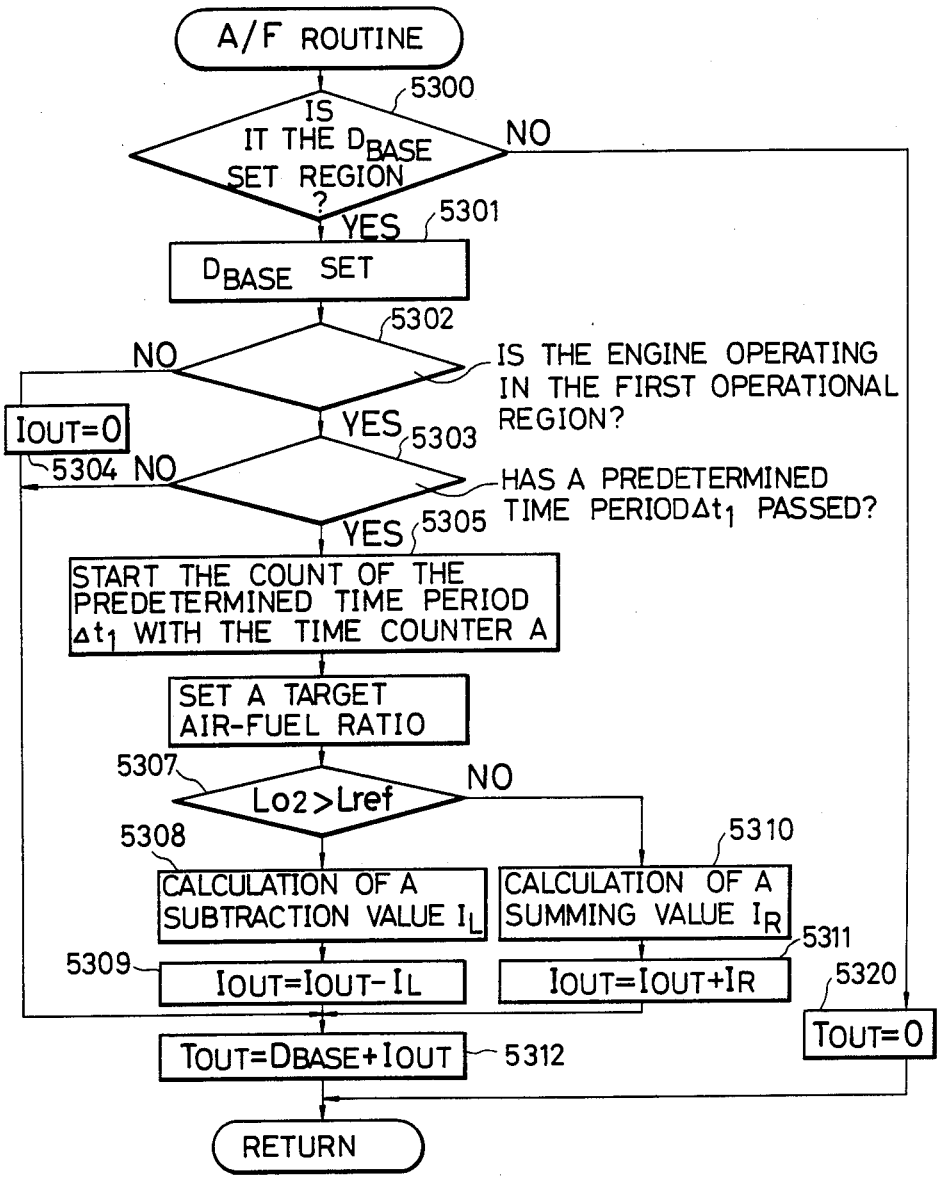
FIG. 9 is a flowchart showing operations of an A/F routine of the second embodiment of the present invention.

Referring to FIGS. 8 and 9, the second embodiment of the air intake side secondary air supply system according to the present invention will be explained hereinafter.

Since the construction and the operation of the second embodiment are the same as those of the first embodiment which have been explained with reference to FIGS. 1 through 7 except the operations of the A/F routine, the explanations thereof are not repeated.

In FIG. 9 which shows the detail of the A/F routine of the second embodiment, whether or not the engine is operating in a region for setting the period of base duty ratio $D_{BASE}$ for the supply of the secondary air, i.e. the opening of the open/close solenoid valve 9 within one duty cycle $T_{SOL}$ is detected at a step 5300. This region is made up of, as shown in FIG. 8, a first operational region I for the F/B (feedback) control and a second operational region II both determined in terms of the absolute pressure within the intake manifold $P_{BA}$ and the engine rotational speed $N_e$. In the example illustrated in FIG. 8, this region is defined by the absolute pressure $P_{BA}$ ranging from 200 mmHg to 660 mmHg, and the engine speed Ne ranging from 500 r.p.m. to 2000 r.p.m.. If it is detected that the operating condition of the engine does not belong to this region for setting the period of base duty ratio $D_{BASE}$, the output valve open period $T_{OUT}$ is made equal to "0" to stop the supply of the secondary air at a step 5320. Conversely, if it is detected that the operating condition of the engine belongs to this region for setting $D_{BASE}$, the period of base duty ratio $D_{BASE}$ is set at a step 5301. As in the case of the previous embodiment, various values of the period of base duty ratio $D_{BASE}$ which are determined according to the absolute pressure within the intake manifold $P_{BA}$ and the engine speed $N_e$ were previously stored in the ROM 30 in the form of a $D_{BASE}$ data map as shown in FIG. 6, the CPU 29 first reads-in current values of the absolute pressure $P_{BA}$ and the engine speed $N_e$ and in turn searches a value of the period of base duty ratio $D_{BASE}$ corresponding to the read-in values from the $D_{BASE}$ data map in the ROM 30. Subsequently, whether or not the engine is operating in the first operation range A for the feedback control is detected at a step 5302. This detection is performed according to the absolute pressure $P_{BA}$ such that the engine is detected to be operating in the first operational region I when the absolute pressure $P_{BA}$ is below 500 mmHg. If it is detected that the engine is operating in the first operational region I, whether or not a count period of the time counter A incorporated in the CPU 29 has reached the predetermined time period $\Delta t_1$ is detected at a step 5303. When the predetermined time period $\Delta t_1$ has passed after the time counter A is reset to start the counting of time, the counter is reset again at a step 5305, to start the counting of time from the initial value. After the start of the counting of the predetermined time period $\Delta t_1$ by the time counter A in this way, the target air-fuel ratio which is leaner than the stoichiometric air-fuel ratio is set at a step 5306. Next, from the information of the oxygen concentration, or not the output signal level $LO_2$ of the $O_2$ sensor 14 is greater than the reference level Lref determined at the step 5306 is detected at a step 5307. In other words, whether or not an air-fuel ratio of the mixture to be supplied to the engine 5 is leaner than the target air-fuel ratio is detected at the step 5307. If $LO_2 > Lref$, it means that the air-fuel ratio of the mixture is leaner that the target air-fuel ratio, and a subtraction value $I_L$ is calculated at a step 5308. After the calculation of the subtraction value $I_L$, a correction value $I_{OUT}$ which is previously calculated by the execution of operation of the A/F routine is read out from a memory location $a_1$ in the RAM 31. Subsequently, the subtraction value $I_L$ is subtracted from the correction value $I_{OUT}$, and a result is in turn written in the memory location $a_1$ of the RAM 31 as a new correction value $I_{OUT}$, at a step 5309. On the other hand, if $LO_2 \leqq Lref$ at the step 5307, it means that the current air-fuel ratio of the mixture is richer than the target air-fuel ratio, and a summing value $I_R$ is calculated at a step 5310. After the calculation of the summing value $I_R$, the correction value $I_{OUT}$ which is previously calculated by the execution of the A/F routine is read out from the memory location $a_1$ of the RAM 31, and the summing value $I_R$ is added to the read out correction value $I_{OUT}$. A result of the summation is in turn stored in the memory location $a_1$ of the RAM 31 as a new correction value $I_{OUT}$ at a step 5311. After the calculation of the correction value $I_{OUT}$ at the step 5309 or the step 5311 in this way, the correction value $I_{OUT}$ and the period of basic duty ratio $D_{BASE}$ set at the step 533 are added together, and a result of addition is used as the valve open period $T_{OUT}$ at a step 5312.

Additionally, after the reset of the time counter A and the start of the counting from the initial value at the step 5305, if it is detected that the predetermined time period $\Delta t_1$ has not yet passed at the step 5303, the operation of the step 5312 is immediately executed. In this case, the correction value $I_{OUT}$ calculated by the A/F routine up to the previous cycle is read out.

If it is detected that the engine is not operating in the first operational region I, it means that the engine operation belongs to the second operating region II. In this case, the correction value $I_{OUT}$ is made equal to "0" at the step 5304 so that the output valve open period $T_{OUT}$ is made equal to the period of base duty ratio $D_{BASE}$.

After the completion of the A/F routine, the system operates in the same way as the previous embodiment, and the explanation thereof will not be repeated.

In this way, improvements of the response characteristic of the system in response to the command of the supply of the air intake side secondary air and the accuracy of the air-fuel ratio control are accomplished by the duty ratio control of the supply of the air intake side secondary air. When the engine is operating in the first operational region I, whether the air-fuel ratio of the mixture to be supplied to the engine is on the rich side or on the lean side with respect to the target air-fuel ratio is detected from the output signal level of the $O_2$ sensor, and the output valve open time period $T_{OUT}$ is calculated in accordance with a result of the detection. Thus the air-fuel ratio of the mixture to be supplied to the engine is controlled toward the target air-fuel ratio.

In brief, in the case of the second embodiment the output valve open period is derived by correcting the base valve open period in accordance with the output signal level of the $O_2$ sensor when the engine is operating in the first operational region. When the engine is operating in the second operational region other than the first operational region, the base valve open period is utilized as the output valve open period. By setting for the first operational region, a region in which the variation of the engine load is relatively small in the case of the second embodiment, it becomes possible to effect the control operation such that the air-fuel ratio follows the target air-fuel ratio continuously, since the air-fuel ratio is controlled by the feedback operation in this region. In this way, the accuracy of the air-fuel ratio control is improved. Further, if a "lean $O_2$ sensor" is employed in this system as in the case of the preferred embodiments, the fuel consumption characteristic will be improved. On the other hand, if a region in which the variation of the engine load is relatively large is set for the second operational region as in the case of the second embodiment, it becomes possible to prevent the delay of the response of the control operation due to the load change, since the air-fuel ratio is controlled according to the operational states of the engine without regard to the output signal level of the $O_2$ sensor. In this way, the driveability of the engine is by far improved as compared with conventional arrangements.

It will be appreciated from the foregoing that, according to the present invention, an $O_2$ sensor whose output signal level is substantially proportional to the oxygen concentration in the exhaust gas is provided and the amount of the supply of the air intake side secondary air is controlled on the basis of the output signal level of the $O_2$ sensor. In other words, an amount of variation of the output signal level of the oxygen concentration sensor corresponds to the amount of variation of the supply of the air intake side secondary air supply. Therefore, the air-fuel ratio is rapidly controlled to the target air-fuel ratio even with the target air-fuel ratio varying in response to the operating states of the engine.

What is claimed is:

1. An air intake side secondary air supply system for an internal combustion engine having an air intake passage with a carburetor and an exhaust passage, comprising:

an air intake side secondary air supply passage leading to the air intake passage on the downstream side of the carburetor;

an open/close valve disposed in said air intake side secondary air supply passage;

an oxygen concentration sensor disposed in the exhaust passage for producing an output signal whose level is substantially proportional to an oxygen concentration of the exhaust gas;

target air/fuel ratio setting means for setting a target air/fuel ratio on the basis of the amount of load of said internal combustion engine;

comparing means for comparing said output of said oxygen concentration sensor with a value corresponding to said target air/fuel ratio; and duty ratio control means including:

(a) means for setting a base valve open period in response to a plurality of engine parameters every first cyclic period, (b) means for detecting an engine operational state according to engine parameters of said engine, (c) means for providing an output valve open period by correcting said base valve open period in accordance with the output signal of said oxygen concentration sensor for effecting a feedback control of air-fuel ratio of mixture to be supplied to the engine in accordance with a result of comparison by said comparing means when said engine operational state detected by said means for detecting an engine operational state is in a first predetermined region, (d) means for controlling said output valve open period in accordance with said base valve open period when said engine operational state is in a second predetermined region different from said first predetermined region, (e) means for controlling said output valve open period to be equal to zero when said engine operational state is in a region other than said first and second predetermined regions, and (f) means for opening said open/close valve during said output valve open period every said first cyclic period.

2. An intake side secondary air supply system for an internal combustion engine having intake and exhaust passages, said intake passage being provided with a carburetor producing an air-fuel mixture and having a throttle valve controlling the air-fuel mixture flow, said secondary air supply system comprising:

an air intake side secondary air supply passage leading to the air intake passage on the downstream side of the throttle valve of said carburetor;

valve means disposed in said air intake side secondary air supply passage for controlling the amount of the secondary air supply so as to make leaner the air/fuel ratio of the air-fuel mixture downstream of the throttle valve;

an oxygen concentration sensor disposed in the exhaust passage and producing an output signal whose level is substantially proportional to an oxygen concentration of the exhaust gas;

target air/fuel ratio setting means for setting a target air/fuel ratio on the basis of the amount of load of said internal combustion engine;

comparing means for comparing said output of said oxygen concentration sensor with a value corresponding to said target air/fuel ratio; and control means which includes:

(a) means for setting a base valve opening in response to a plurality of engine parameters of said engine;

(b) means for detecting an engine operational state according to engine parameters of said engine;

(c) means for providing an output valve opening by correcting said base valve opening in accordance with the output signal of said oxygen concentration sensor for effecting a feedback control of air-fuel ratio of mixture to be supplied to the engine in accordance with a result of comparison by said comparing means when said engine operational state detected by said means for detecting an engine operational state is in a first predetermined region;

(d) means for controlling said output valve opening in accordance with said base valve opening when said engine operational state is in a second predetermined region different from said first predetermined region;

(e) means for controlling said output valve opening to be equal to zero when said engine operational state is in a region other than said first and second predetermined regions; and (f) means for driving said valve means in response to said output valve opening.

3. An air intake side secondary air supply system for an internal combustion engine having intake and exhaust passages, said intake passage being provided with a carburetor producing an air-fuel mixture and having a throttle valve controlling the air-fuel mixture flow, said secondary air supply system comprising:

an air intake side secondary air supply passage leading to the intake passage on the downstream side of the throttle valve of said carburetor;

a flow control valve disposed in said air intake side secondary air supply passage for controlling the amount of the secondary air supply so as to make leaner the air/fuel ratio of the air-fuel mixture downstream of the throttle valve;

an oxygen concentration sensor disposed in the exhaust passage for producing an output signal whose level is substantially proportional to an oxygen concentration of the exhaust gas;

target air/fuel ratio setting means for setting a target air/fuel ratio on the basis of the amount of load of said internal combustion engine;

comparing means for comparing said output of said oxygen concentration sensor with a value corresponding to said target air/fuel ratio; and control means for controlling the opening of said flow control valve in response to a result of comparison by said comparing means.

4. An air intake side secondary air supply system as set forth in claim 1, in which the level of said output signal of said oxygen concentration sensor is substantially proportional to the oxygen concentration of the exhaust gas when an air-fuel ratio of mixture supplied to the engine is on a lean side with respect to a stoichiometric air-fuel ratio.

5. An air intake side secondary air supply system as set forth in claim 1, wherein said control means includes means for setting a base duty ratio in response to engine parameters every first cyclic period, means for setting a correction value for said base duty ratio in accordance with the output signal level of the oxygen concentration sensor every second cyclic period, means for setting a value obtained by adding said correction value to said base duty ratio every said first cyclic period, as a period of opening of said flow control valve within said first cyclic period.

6. An air intake side secondary air supply system as set forth in claim 5, wherein said second cyclic period for setting the correction value is varied according to the engine parameters.

7. An air intake side secondary air supply system as set forth in claim 5, wherein said means for setting a correction value includes means for comparing the output signal level of the oxygen concentration sensor with a level corresponding to a target air-fuel ratio every said second cyclic period, and means for adding one of a predetermined subtraction value and a predetermined addition value to a correction value obtained by a previous calculation cycle in accordance with a result of comparison by said comparing means, to renew the correction value.

8. An air intake side secondary air supply system as set forth in claim 7, wherein said second cyclic period for setting the correction value is varied according to the engine parameters.

* * * * *